US006958089B1

(12) United States Patent
Huang

(10) Patent No.: US 6,958,089 B1
(45) Date of Patent: Oct. 25, 2005

(54) STRUCTURE OF AN ELECTROSTATIC PRECIPITATOR

(75) Inventor: Ping Huang, Tainan Hsien (TW)

(73) Assignee: Hung Hsing Electric Co., Ltd., Tainan Hsien (TW)

( * ) Notice: Subject to any disclaimer, the term of this patent is extended or adjusted under 35 U.S.C. 154(b) by 0 days.

(21) Appl. No.: 10/878,377

(22) Filed: Jun. 29, 2004

(51) Int. Cl.[7] ..... B03C 3/47

(52) U.S. Cl. ..... 96/79; 96/86; 96/87; 96/100; 248/606

(58) Field of Search ..... 96/79, 83, 86–88, 96/100; 248/606; 411/61, 177, 368, 520, 411/531, 539, 968

(56) References Cited

U.S. PATENT DOCUMENTS

| | | | | | |
|---|---|---|---|---|---|
| 2,170,718 | A | * | 8/1939 | Humphries | 384/28 |
| 2,535,696 | A | * | 12/1950 | Richardson | 96/86 |
| 2,869,678 | A | * | 1/1959 | Roberts | 96/79 |
| 3,012,743 | A | * | 12/1961 | Jenkins | 248/606 |
| 3,017,952 | A | * | 1/1962 | Westlin | 96/86 |
| 3,017,953 | A | * | 1/1962 | Rivers | 96/86 |
| 3,018,844 | A | * | 1/1962 | Gonzalez | 96/86 |
| 3,018,846 | A | * | 1/1962 | Czerwonka et al. | 96/86 |
| 3,114,616 | A | * | 12/1963 | Palmore | 96/86 |
| 3,175,341 | A | * | 3/1965 | Winter | 96/86 |
| 3,300,850 | A | * | 1/1967 | Steuernagel | 29/432.1 |
| 3,464,656 | A | * | 9/1969 | Boden et al. | 248/606 |
| 3,581,470 | A | * | 6/1971 | Aitkenhead et al. | 96/79 |
| 3,985,525 | A | * | 10/1976 | Tomaides | 96/79 |
| 4,071,688 | A | * | 1/1978 | Lynch et al. | 96/88 |
| 4,231,766 | A | * | 11/1980 | Spurgin | 96/79 |
| 4,290,788 | A | * | 9/1981 | Pittman et al. | 96/86 |
| 4,569,684 | A | * | 2/1986 | Ibbott | 96/79 |
| 4,759,779 | A | * | 7/1988 | Shedd | 96/87 |
| 4,801,230 | A | * | 1/1989 | Wilburn | 411/61 |
| 4,869,736 | A | * | 9/1989 | Ivester et al. | 96/100 |
| 5,100,439 | A | * | 3/1992 | Kemp | 96/86 |
| 5,137,552 | A | * | 8/1992 | Sasaki | 96/80 |
| 5,421,863 | A | * | 6/1995 | Rector et al. | 96/60 |
| 5,433,772 | A | * | 7/1995 | Sikora | 96/87 |
| 5,520,010 | A | * | 5/1996 | Altman | 62/341 |
| 5,529,608 | A | * | 6/1996 | Jonelis | 95/57 |
| 6,058,671 | A | * | 5/2000 | Strickland | 52/580 |
| 6,096,119 | A | * | 8/2000 | Ho et al. | 96/79 |
| 6,576,046 | B2 | * | 6/2003 | Pruette et al. | 96/26 |
| 6,852,149 | B2 | * | 2/2005 | Huang | 96/79 |
| 2005/0045038 | A1 | * | 3/2005 | Huang | 96/83 |

FOREIGN PATENT DOCUMENTS

| | | | | |
|---|---|---|---|---|
| JP | 4-322757 | * | 11/1992 | 96/87 |

* cited by examiner

*Primary Examiner*—Richard L. Chiesa
(74) *Attorney, Agent, or Firm*—Rosenberg, Klein & Lee

(57) ABSTRACT

An electrostatic precipitator includes a frame, several parallel square metallic rods securely disposed in the frame, and several metallic boards positioned parallel in the frame for charges to be deposited on, and spacing elements; the metallic boards have through holes thereon, and the square metallic rods are passed through corresponding through holes of the metallic boards; the spacing elements are in the shape of a tube having a lengthwise extending gap, and they are positioned one on top of another around a whole length of the metallic rods for spacing the metallic boards equidistantly apart with; the spacing elements are flexible and resilient so as to tightly embrace the metallic rods when they are fitted around the rods.

2 Claims, 6 Drawing Sheets

STRUCTURE OF AN ELECTROSTATIC PRECIPITATOR

BACKGROUND OF THE INVENTION

1. Field of the Invention

The present invention relates to an electrostatic precipitator, more particularly one, including metallic boards for charges to be deposited on, metallic rods for supporting the boards in position, and spacing elements, which are positioned one on top of another around the rods for spacing the boards equidistantly apart, and which are formed with such a shape as to be easily fitted onto, and tightly embrace the metallic rods.

2. Brief Description of the Prior Art

Electrostatic precipitators, dust filtering devices, and ion generators are three major kinds of air cleaning devices, among which electrostatic precipitators occupy least space, can function with high dust collecting efficiency for longest period of time, and are convenient to use, and cheapest to manufacture and maintain.

Referring to FIG. 1, a common structure of electrostatic precipitators includes a frame, several first and second metallic boards positioned parallel one above another in the frame, and metallic rods for supporting the metallic boards in position; the first metallic boards have positive charges deposited thereon while the second metallic boards have negative charges deposited thereon; each metallic board has big through holes, and small through holes thereon. The small through holes have such a size that the metallic rods will be closely fitted therein when the rods are passed through them. And, the big through holes have such a size that the metallic rods won't touch the metallic boards when the rods are passed through them.

All of the metallic boards are arranged such that every two nearest ones of the first boards have one second board interposed in between, and every two nearest ones of the second boards have one first board interposed in between, and such that the big through holes of each first board will be aligned with corresponding big through holes of the other ones of the first boards, and aligned with the corresponding small through holes of the second boards.

The metallic rods are passed through corresponding through holes of the metallic boards. Thus, positive charges can be transferred to the first metallic boards via those of the metallic rods that touch them, and negative charges can be transferred to the second metallic boards via those of the metallic rods that touch them; thus, dust that carry charges can be attracted to the metallic boards, and air cleaned.

Referring to FIG. 1 again, spacing tubes are provided to the above structure of electrostatic precipitators for spacing the metallic boards equidistantly apart with. The spacing tubes are positioned one on top of another around a whole length of the metallic rods, and are formed with such a size that they can pass through the big through holes, but they can't pass through the small through holes; thus, the metallic boards can be held equidistantly apart with the help of the spacing tubes.

However, because all of the spacing tubes have to be passed around the metallic rods from the ends of the rods in assembling the electrostatic precipitator, it will be difficult to fit the spacing tubes in position, and in turns, it will take much time and labor to assemble the electrostatic precipitator if the inner diameter of the spacing tubes is close to the diameter of the metallic rods. On the other hand, undesired displacement of the spacing tubes relative to the metallic rods will happen if the spacing tubes are formed with such a size as to be easily fitted around the metallic rods. Therefore, there is room for improvement in the above spacing tubes.

SUMMARY

It is a main object of the present invention to provide an improvement on an electrostatic precipitator to overcome the above disadvantages.

The electrostatic precipitator of the present invention includes a frame, several parallel square metallic rods securely disposed in the frame, and several metallic boards positioned parallel in the frame for charges to be deposited on, and spacing elements. The metallic boards have through holes thereon, and the metallic rods are passed through corresponding through holes of the metallic boards. The spacing elements are in the shape of a tube having a lengthwise extending gap, and they are positioned one on top of another around a whole length of the metallic rods for spacing the metallic boards equidistantly apart with. Furthermore, the spacing elements are flexible and resilient such that they can be easily fitted around the metallic rods, and such that they can tightly embrace the metallic rods.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
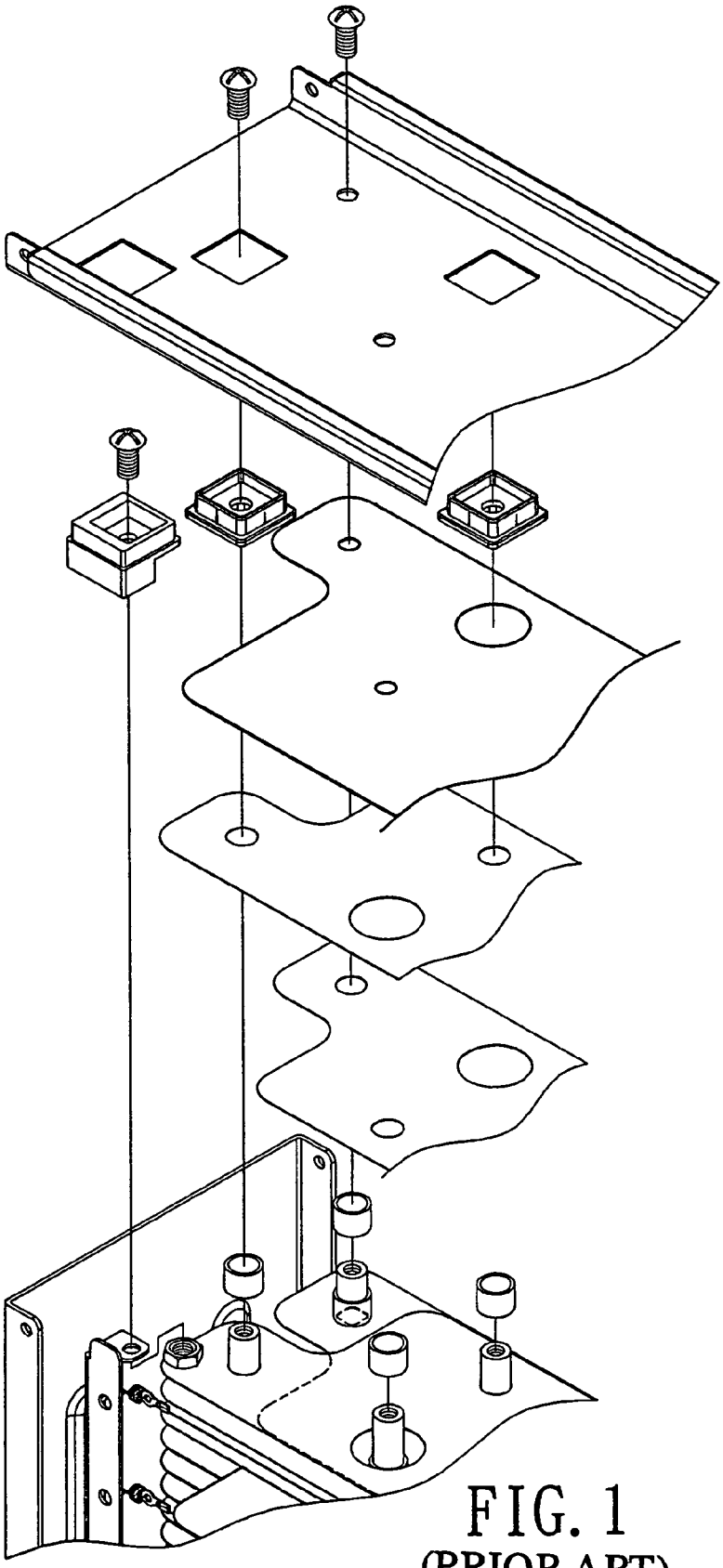
FIG. 1 (PRIOR ART)
FIG. 1 is a partial exploded perspective view of the conventional electrostatic precipitator.
Figure 2:
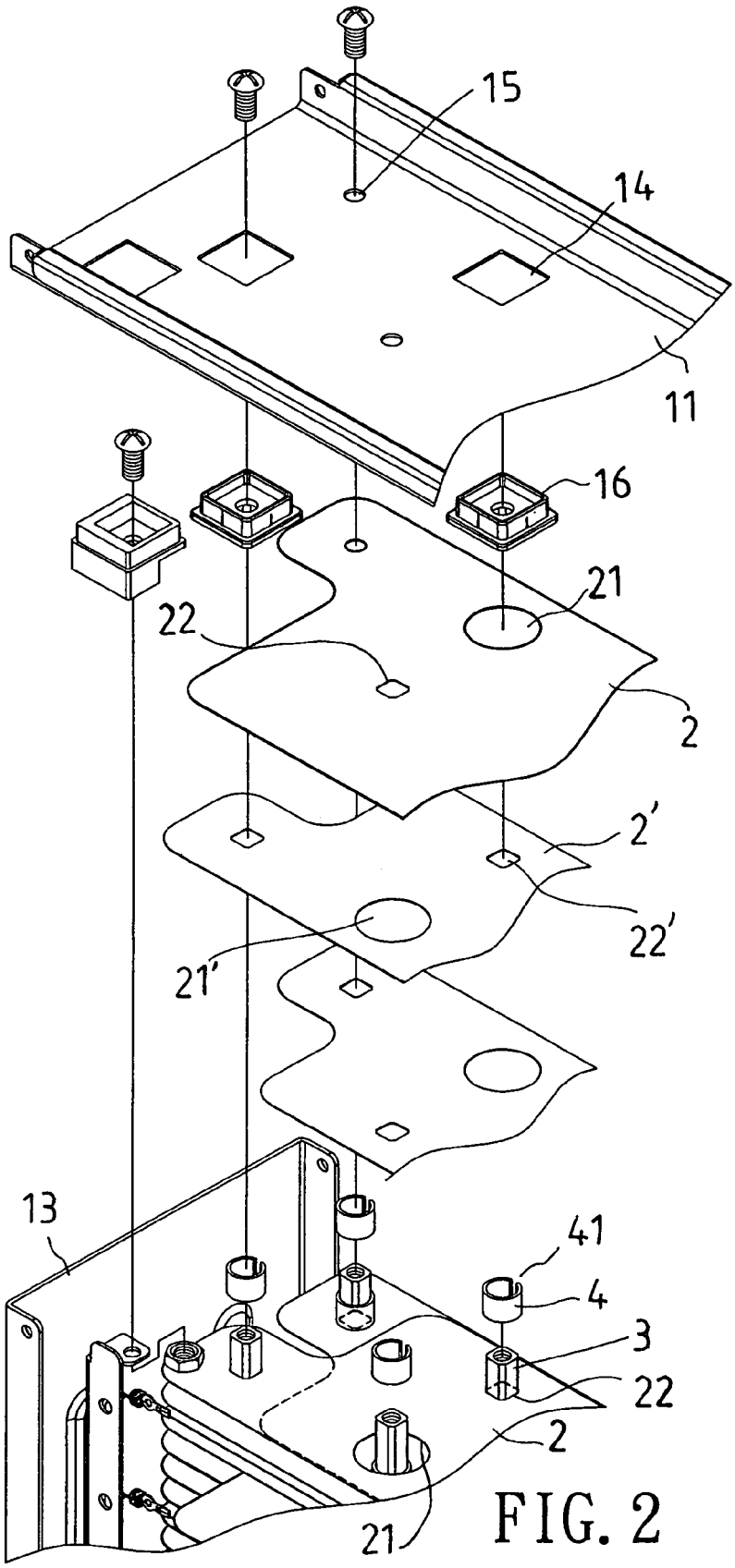
FIG. 2 is a partial exploded perspective view of the electrostatic precipitator according to the present invention.
Figure 3:
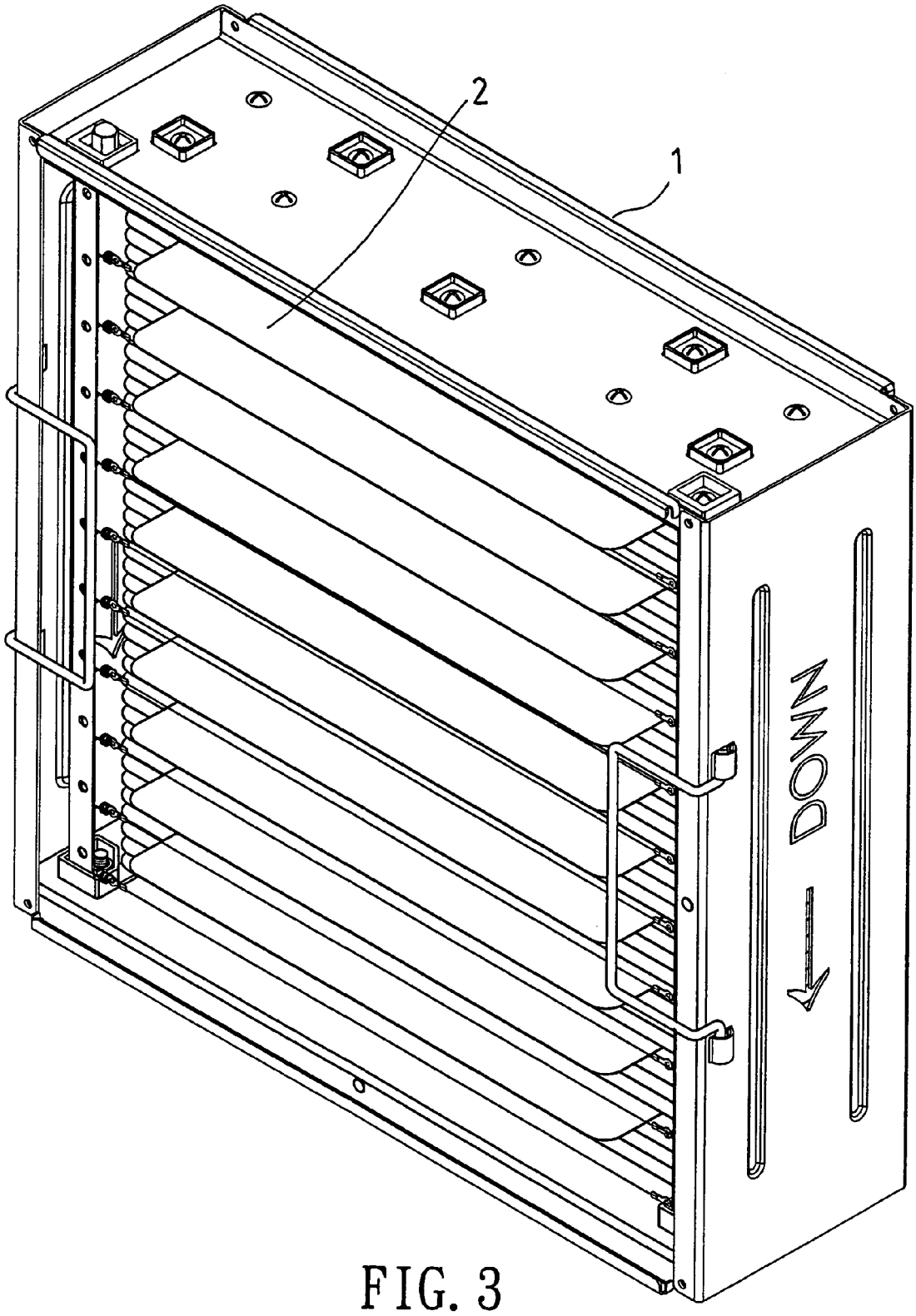
FIG. 3 is a perspective view of the present electrostatic precipitator.

Referring to FIGS. 2 and 3, a preferred embodiment of an electrostatic precipitator of the present invention includes a frame 1, a first group of metallic boards 2, a second group of metallic boards 2', several metallic rods 3, and several spacing elements 4.

The frame 1 consists of an uppermost board 11, a lowermost board 12, and several supporting rods 13 whose upper and lower ends are respectively connected with edges of the uppermost board 11 and the lowermost board 12. Each of the boards 11 and 12 has several holding holes 14, and several fitting holes 15, each of which holding holes 14 has a plug 16 fitted therein.

The metallic rods 3 are square, and they are disposed upright in the frame 1 with upper ends thereof being connected with respective ones of the plugs 16 and the fitting holes 15 of the uppermost board 11, and with lower ends thereof being connected with respective ones of the plugs 16 and the fitting holes 15 of the lowermost board 12.

Figure 4:
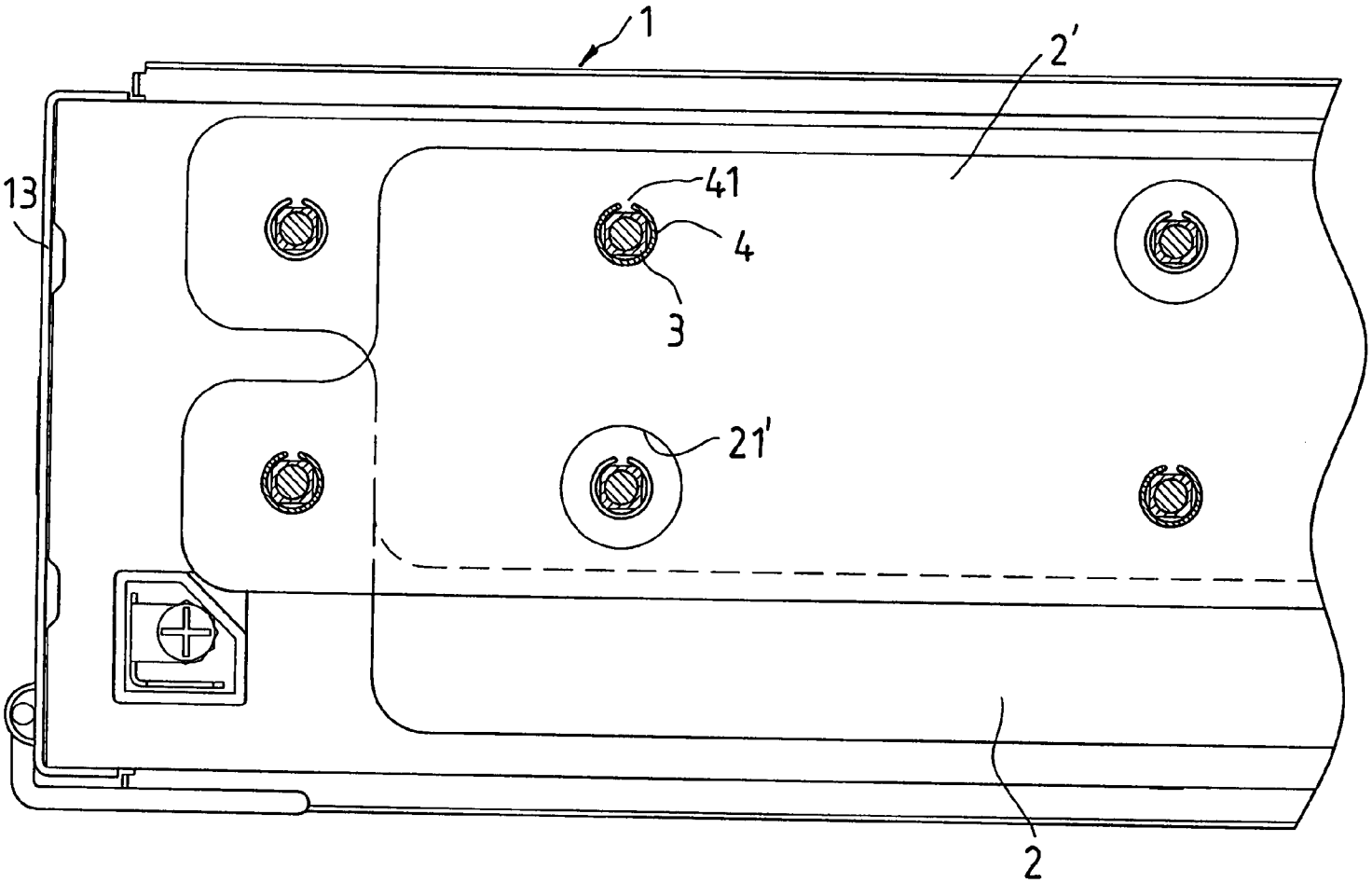
FIG. 4 is a partial bottom view of the electrostatic precipitator of the present invention.

The spacing elements 4 are in the shape of a cylindrical tube having a lengthwise extending gap 41, flexible and resilient. The spacing elements 4 are positioned one on top of another around a whole length of the metallic rods 3 such that the gaps 41 thereof all face flat sides of the metallic rods 3 as shown in FIG. 4. Furthermore, the spacing elements 4 can tightly embrace the metallic rods 3 to be steady when they are fitted around the rods 3.

The metallic boards 2 and 2' are positioned parallel and one above another between the uppermost and the lowermost boards 11 and 12 of the frame 1. The first metallic boards 2 have positive charges deposited thereon while the second metallic boards 2' have negative charges deposited thereon. Each metallic board 2 has big through holes 21, and small through holes 22 thereon while each metallic board 2' has big through holes 21', and small through holes 22' thereon. The big through holes 21 and 21' are round while the small through holes 22 and 22' are square.

In addition, the spacing elements 4 are formed with such a size that they can pass through the big through holes 21, 21' of the metallic boards 2 and 2', but they can't pass through the small through holes 22, 22'. And, the square metallic rods 3 are formed with such a size as to be closely fitted in the small through holes 22, 22'.

All of the metallic boards 2 and 2' are arranged such that every two nearest ones of the first boards 2 have one second board 2' interposed in between, and every two nearest ones of the second boards 2' have one first board 2 interposed in between, and such that the big through holes 21 of each first board 2 will be aligned with corresponding big through holes 21 of the other ones of the first boards 2 as well as being aligned with the corresponding small through holes 22' of the second boards 2'.

The metallic rods 3 are passed through corresponding through holes 21, 22' (22, 21') of the metallic boards 2 and 2'. Thus, the metallic rods 3 are closely fitted in the corresponding small through holes 22, 22'. And, upper and lower ends of each spacing element 4 come into contact with two corresponding metallic boards 2, 2' that are respectively right above, and right under the spacing element 4.

Figure 5:
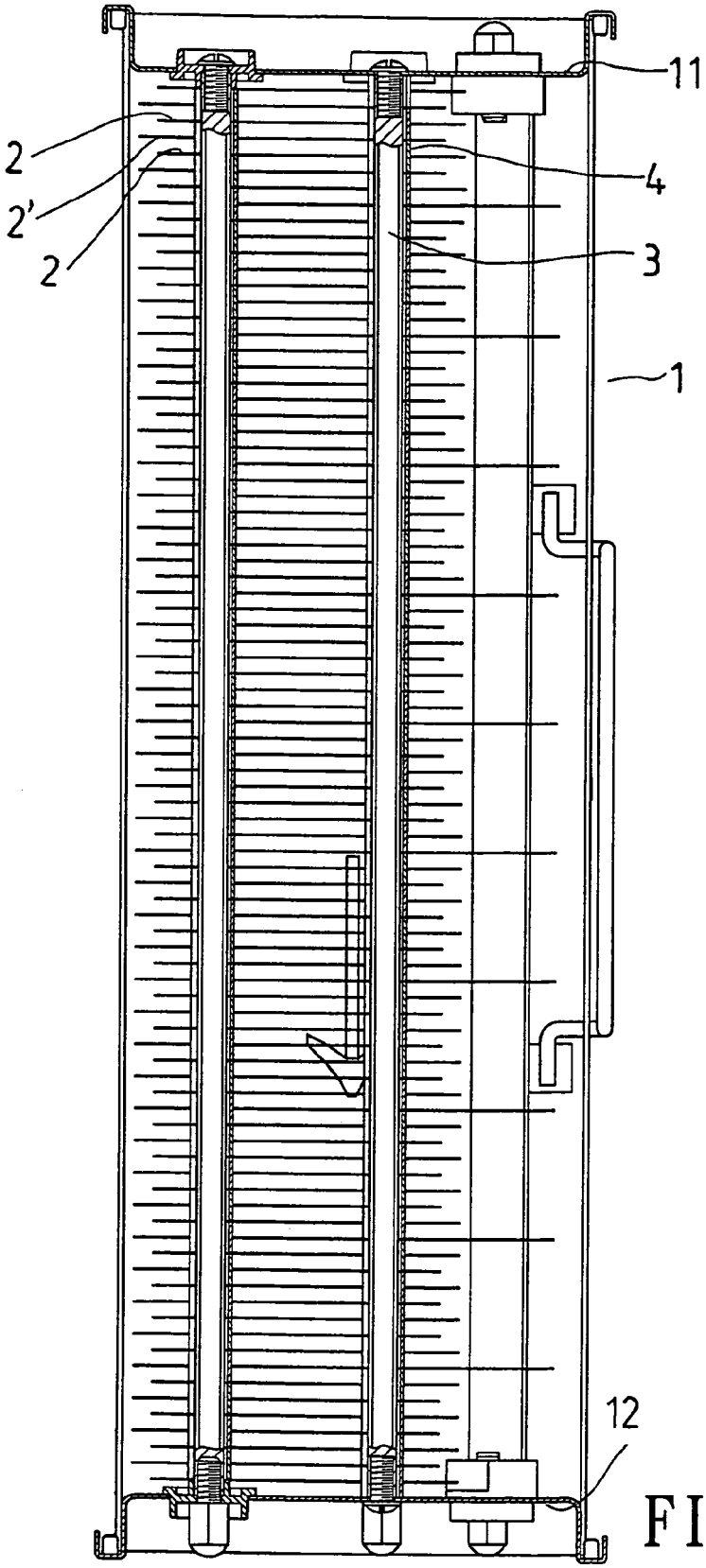
FIG. 5 is a vertical section of the electrostatic precipitator of the present invention, which is parallel to the lateral sides.
Figure 6:
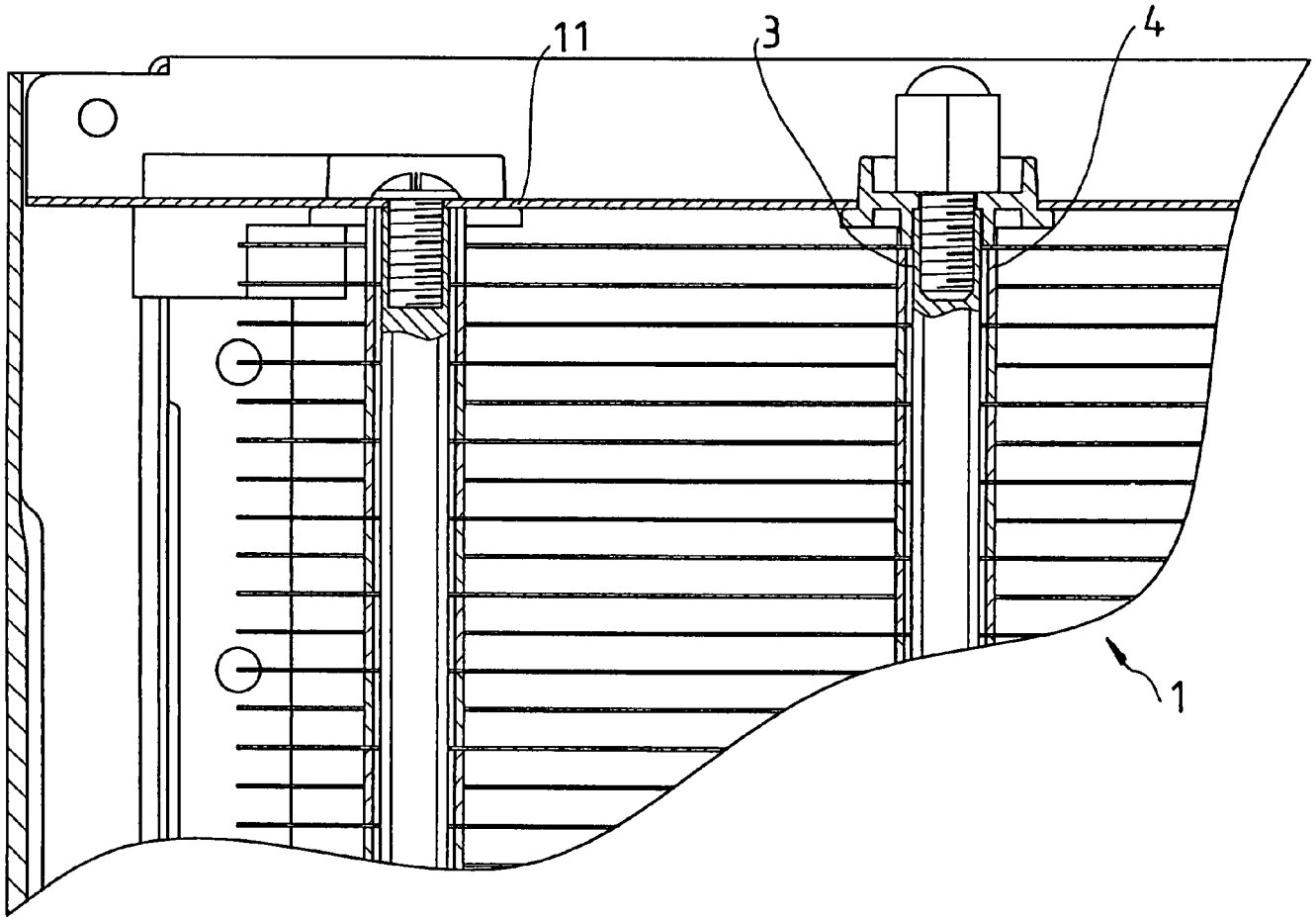
FIG. 6 is a partial vertical section of the electrostatic precipitator of the present invention, which is parallel to the lateral sides.

Consequently, the metallic boards 2 and 2' are equidistantly spaced apart and held in a steady position with the help of the metallic rods 3 and the spacing elements 4, as shown in FIGS. 5 and 6.

From the above description, it can be understood that the electrostatic precipitator of the present invention has advantages as followings:

1. The spacing elements 4, which are in the shape of a tube with a lengthwise extending gap, can tightly embrace the square metallic rods 3. Therefore, there won't be undesired displacement of the spacing elements 4 relative to the metallic rods 3.
2. Because the spacing elements 4 have a lengthwise extending gap 41, and are flexible and resilient, they can be stretched to have a larger space therein. Consequently, the spacing elements 4 can be more easily fitted around the metallic rods than the conventional spacing tubes as described in Background. In other words, the present electrostatic precipitator is relatively easy to assemble as compared with the conventional one.

What is claimed is:

1. An electrostatic precipitator, comprising a frame;

a plurality of substantially parallel square metallic rods securely disposed in the frame;

a plurality of metallic boards positioned substantially parallel in the frame for charges to be deposited on; the metallic boards having a plurality of first through holes and second through holes thereon; the metallic rods being passed through corresponding through holes of the metallic boards; and a plurality of spacing elements positioned one on top of another around the metallic rods for spacing the metallic boards equidistantly apart with; the spacing elements being in a shape of a tube having a lengthwise extending gap; the spacing elements being flexible and resilient so as to tightly embrace the metallic rods when they are fitted around the rods.

2. The electrostatic precipitator as claimed in claim 1, wherein the second through holes of the metallic boards are square for the metallic rods to be closely fitted therein.

* * * * *